US009631339B2

(12) United States Patent
Bussio

(10) Patent No.: US 9,631,339 B2
(45) Date of Patent: Apr. 25, 2017

(54) REHABILITATION OF DETERIORATED MANHOLE AND OTHER SEWER STRUCTURES

(71) Applicant: Vincent Bussio, Orem, UT (US)

(72) Inventor: Vincent Bussio, Orem, UT (US)

(73) Assignee: Geneva Polymer Products, LLC, Orem, UT (US)

( * ) Notice: Subject to any disclaimer, the term of this patent is extended or adjusted under 35 U.S.C. 154(b) by 0 days.

(21) Appl. No.: 14/071,506

(22) Filed: Nov. 4, 2013

(65) Prior Publication Data

US 2014/0137508 A1 May 22, 2014

Related U.S. Application Data

(63) Continuation of application No. 13/867,860, filed on Apr. 22, 2013, now abandoned, which is a continuation of application No. 13/683,750, filed on Nov. 21, 2012, now abandoned, which is a continuation of application No. 13/539,263, filed on Jun. 29, 2012, now abandoned, which is a (Continued)

(51) Int. Cl.

| | |
|---|---|
| ***E02D 29/09*** | (2006.01) |
| ***E02D 29/12*** | (2006.01) |
| ***E03F 5/02*** | (2006.01) |
| ***E21D 11/08*** | (2006.01) |

(52) U.S. Cl.

CPC ..... *E02D 29/128* (2013.01); *E02D 29/125* (2013.01); *E03F 5/025* (2013.01); *E21D 11/08* (2013.01)

(58) Field of Classification Search

CPC ..... E02D 29/125; E02D 29/128; E21D 11/08; E03F 5/025; E03F 2003/065; F16L 55/1657

USPC ..... 264/36.16; 52/514.5, 742.16; 138/97, 138/98; 156/94; 405/184.2

See application file for complete search history.

(56) References Cited

U.S. PATENT DOCUMENTS 992,782 A * 5/1911 Lambie ..... 264/32
1,712,510 A 5/1929 Monie (Continued)

FOREIGN PATENT DOCUMENTS

JP 200697368 * 4/2006

*Primary Examiner* — Robert Canfield
(74) *Attorney, Agent, or Firm* — Clayton, Howarth & Cannon, P.C.

(57) ABSTRACT

A new inner passageway through a pre-cast concrete structure damaged by corrosion may be formed by stackable inserts formed of polymer concrete. The inserts may be stacked in the old passageway through the pre-cast concrete structure such that an inner surface of the stacked inserts forms a new passageway through the pre-cast concrete structure. A grout may be poured between an outer surface of the stacked inserts and an inner surface of the pre-cast concrete structure forming the old passageway. The surfaces of the stackable inserts may have superior resistance to corrosive acids such that the need for future repair is greatly reduced. Suitable pre-cast concrete structures for rehabilitation include pre-cast concrete structures utilized in wastewater systems, including manholes and other similar structures. In this manner, the damaged pre-cast concrete structures do not need to be removed during the rehabilitation.

41 Claims, 11 Drawing Sheets

Related U.S. Application Data continuation of application No. 13/372,388, filed on Feb. 13, 2012, now abandoned, which is a continuation of application No. 13/245,830, filed on Sep. 26, 2011, now abandoned.

(60) Provisional application No. 61/386,436, filed on Sep. 24, 2010.

(56) References Cited

U.S. PATENT DOCUMENTS 4,170,248 A * 10/1979 Bennett et al. ..... 138/97
4,401,397 A * 8/1983 Sommer et al. ..... 405/133
4,473,322 A * 9/1984 Echols et al. ..... 405/133
4,497,590 A * 2/1985 Chase ..... 405/152
4,585,371 A * 4/1986 Jones-Hinton ..... 405/153
4,737,220 A 4/1988 Ditcher et al.
4,768,562 A * 9/1988 Strand ..... 138/98
4,995,584 A * 2/1991 Trimble ..... 249/10
4,997,602 A * 3/1991 Trimble ..... 264/32
5,017,313 A 5/1991 Trimble
5,032,197 A * 7/1991 Trimble ..... 156/71
5,384,355 A * 1/1995 Allen ..... 524/650
5,386,669 A 2/1995 Almeida
5,458,155 A * 10/1995 Stephens ..... 138/98
5,511,897 A 4/1996 House et al.
5,531,485 A 7/1996 House et al.
5,608,998 A * 3/1997 Hume ..... 52/245
5,725,328 A * 3/1998 Schmager ..... 405/151
5,791,378 A * 8/1998 Stephens ..... 138/98
5,876,533 A 3/1999 House et al.
5,928,447 A * 7/1999 GianFrancisco ..... 156/94
5,956,905 A 9/1999 Wiedrich
6,089,279 A * 7/2000 Clarke et al. ..... 138/157
6,195,944 B1 * 3/2001 Goldthorpe ..... 52/19
6,196,760 B1 3/2001 Sinclair
6,494,978 B1 * 12/2002 Bertram ..... 156/79
6,565,935 B1 * 5/2003 Lohnes ..... 428/35.7
6,877,281 B1 4/2005 Gavin
7,018,577 B2 * 3/2006 Bilgram et al. ..... 264/135
7,165,578 B2 * 1/2007 Kamiyama et al. ..... 138/98
7,223,051 B1 5/2007 Vought et al.
7,819,435 B2 * 10/2010 Kamiyama et al. ..... 285/15
7,955,026 B2 * 6/2011 Kamiyama et al. ..... 405/55
8,327,886 B2 * 12/2012 Nishiyama ..... 138/98
8,360,108 B2 * 1/2013 Kamiyama et al. ..... 138/98
2003/0136455 A1 * 7/2003 Kamiyama et al. ..... 138/98
2004/0108009 A1 * 6/2004 Kamiyama et al. ..... 138/97
2005/0238437 A1 * 10/2005 Kamiyama et al. ..... 405/184.1
2010/0209196 A1 * 8/2010 Harvey ..... 405/150.1
2013/0241199 A1 * 9/2013 Bussio ..... 285/399
2013/0284298 A1 * 10/2013 Kamiyama et al. ..... 138/98
2014/0115975 A1 * 5/2014 Bussio ..... 52/19

* cited by examiner

REHABILITATION OF DETERIORATED MANHOLE AND OTHER SEWER STRUCTURES

CROSS-REFERENCE TO RELATED APPLICATIONS

This application is a continuation of U.S. patent application Ser. No. 13/867,860, filed Apr. 22, 2013, which is a continuation of U.S. patent application Ser. No. 13/683,750, filed Nov. 21, 2012, which is a continuation of U.S. patent application Ser. No. 13/539,263, filed Jun. 29, 2012, which is a continuation of U.S. patent application Ser. No. 13/372,388, filed Feb. 13, 2012, which is a continuation of U.S. patent application Ser. No. 13/245,830, filed Sep. 26, 2011, which claimed the benefit of U.S. Provisional Application No. 61/386,436, filed on Sep. 24, 2010, which are hereby incorporated by reference herein in their entireties, including but not limited to those portions that specifically appear hereinafter, the incorporation by reference being made with the following exception: In the event that any portion of the above-referenced applications are inconsistent with this application, this application supercedes said above-referenced applications.

STATEMENT REGARDING FEDERALLY SPONSORED RESEARCH OR DEVELOPMENT

Not Applicable.

BACKGROUND

1. The Field of the Present Disclosure

The present disclosure relates generally to wastewater systems, and more particularly, but not necessarily entirely, to rehabilitating pre-cast wastewater structures damaged by corrosion.

2. Description of Related Art

Some components of wastewater systems in the U.S. may be formed from pre-cast concrete structures. For example, pre-cast concrete structures may include concrete pipes, box culverts, vaults, catch basins, and manhole assemblies. These pre-cast concrete structures may be formed off site and transported to a work site as needed. At the work site, the pre-cast concrete structures may be installed into wastewater systems, including sewage systems, as is known to one having ordinary skill in the art. Typically, the pre-cast concrete structures may be installed underground.

The pre-cast concrete structures used in wastewater systems are highly susceptible to microbial induced corrosion. Microbial induced corrosion is caused when hydrogen sulfide gas is released from wastewater. The gas is transformed into sulfuric acid by microbes present in the wastewater system. The sulfuric acid produced by the microbes may then quickly corrode the concrete structures by dissolving the cement binder used during the casting process. The corrosion caused by sulfuric acid may lead to severe damage to the pre-cast concrete structures.

Some attempts have been made in the prior art to reduce the damage caused by microbial induced corrosion. For example, one attempt at reducing microbial induced corrosion may include spraying a coating, such as an epoxy coating, on the pre-cast concrete structures. Disadvantageously, these coatings have been known to spall; thereby creating a pathway for the acid to eat away at the concrete. Other attempts to reduce the damage caused by microbial induced corrosion have included the use of plastic liners, which have also been demonstrated as not being completely effective. In other instances, repair of corroded concrete structures in wastewater systems may include removing the structures and replacing them with new structures. This approach, however, is time and cost prohibitive given that the structures are typically buried underground. Further, the new structures may also be susceptible to corrosion.

Despite the advantages of known techniques for repairing corroded concrete structures in wastewater systems, improvements are still being sought. The prior art is thus characterized by several disadvantages that are addressed by the present disclosure. The present disclosure minimizes, and in some aspects eliminates, the above-mentioned failures, and other problems, by utilizing the methods and structural features described herein.

The features and advantages of the present disclosure will be set forth in the description which follows, and in part will be apparent from the description, or may be learned by the practice of the present disclosure without undue experimentation. The features and advantages of the present disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
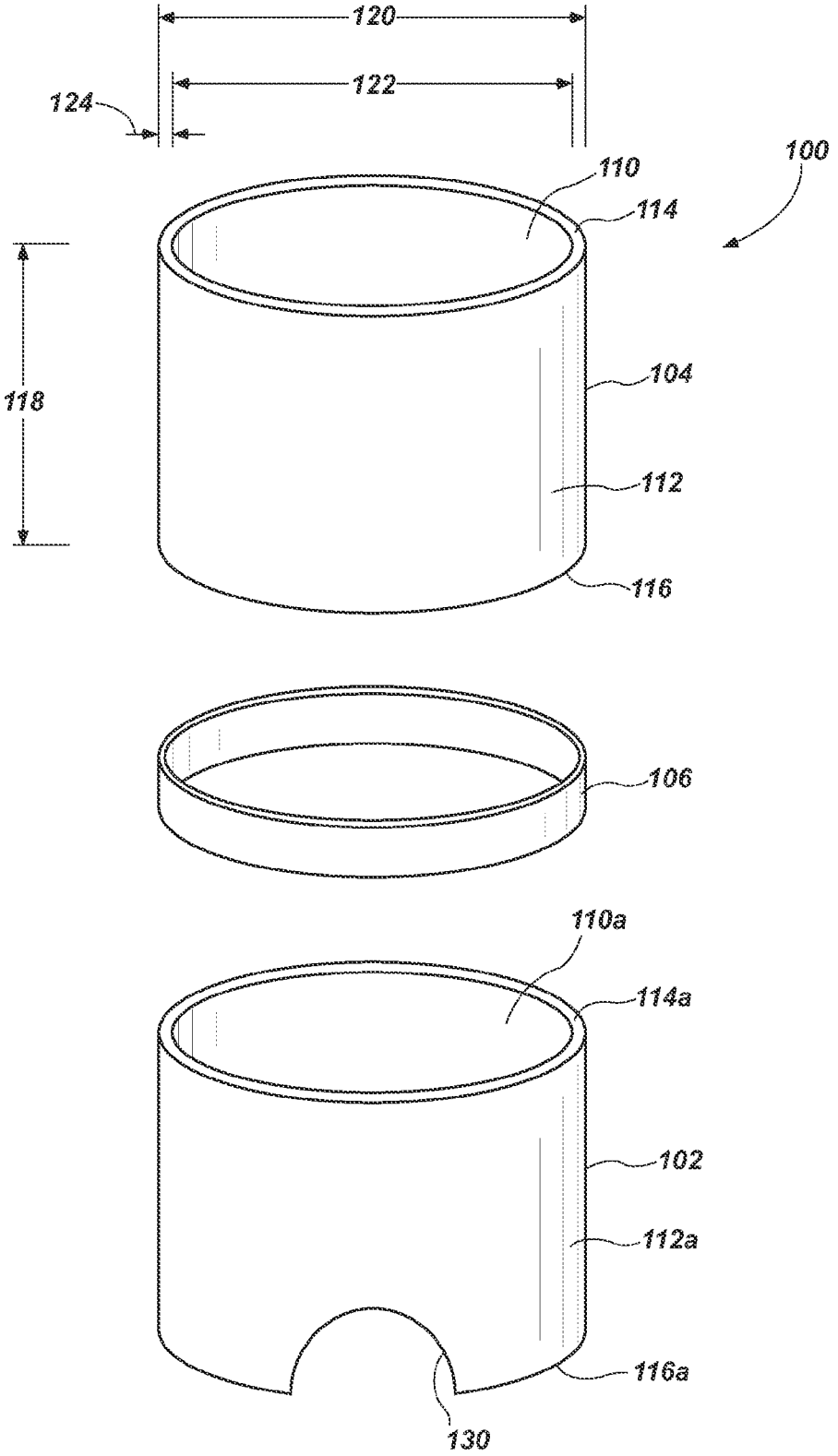
FIG. 1 is an exploded view of a stacked insert assembly for use in rehabilitating pre-cast concrete structures in a wastewater system pursuant to an embodiment of the present disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

In describing and claiming the present disclosure, the following terminology will be used in accordance with the definitions set out below. It must be noted that, as used in this specification and the appended claims, the singular forms "a," "an," and "the" include plural referents unless the context clearly dictates otherwise. As used herein, the terms "comprising," "including," "containing," "characterized by," "having," and grammatical equivalents thereof are inclusive or open-ended terms that do not exclude additional, unrecited elements or method steps.

Pursuant to an embodiment of the present disclosure, Applicant has discovered a system and method for rehabilitating pre-cast concrete structures damaged by corrosion or in some other manner. These pre-cast concrete structures may use a cement binder. In some instances, the damage to the pre-cast concrete structures may be caused by an acid produced by microbes present in a wastewater environment. In an embodiment, the present disclosure may include one or more stackable inserts formed from polymer concrete. The polymer concrete may comprise a polymer binder and an aggregate, e.g., a sand and gravel mixture.

Inserts according to the present disclosure may be pre-cast and may include an inner surface and an outer surface that define therebetween a wall thickness. The inner surface may also form a passageway through the inserts. The overall diameter of the inserts may be less than the original passageway through the pre-cast concrete structure such that the inserts may be stacked vertically in the original passageway. The inner surface of the inserts may form a new passageway in a pre-cast concrete structure damaged by corrosion. A grout, or other void filling material, may be poured or placed into a void formed between the old passageway and the outer surface of the stacked inserts.

A watertight, or substantially watertight, seal may be formed between adjacent ones of the stacked inserts through the use of an annular sealing member. The surface of the new passageway formed by the stacked inserts may be resistive to the corrosive effects of acids and other harmful substances found in wastewater systems such that the need for future repair is greatly reduced.

Referring now to FIG. 1, there is depicted an exploded view of an insert assembly 100 for rehabilitating a pre-cast concrete structure pursuant to an embodiment of the present disclosure. The insert assembly 100 may comprise a plurality of stackable inserts, namely, inserts 102 and 104. In an embodiment of the present disclosure, only a single insert may be utilized. In an embodiment of the present disclosure, any number of stackable inserts may be utilized. In an embodiment of the present disclosure, the inserts 102 and 104 may be cylindrically shaped.

Each of the inserts 102 and 104 may be formed from a polymer concrete. As used herein, the term "polymer concrete" may refer to those concretes that use polymers to replace cement as a binder. Polymer concrete may, therefore, include a polymer binding agent and an aggregate. In an embodiment of the present disclosure, the aggregate used in polymer concrete may include at least one of sand and gravel, or both. The inserts 102 and 104 may be formed pursuant to the methods disclosed in U.S. patent application Ser. No. 13/085,449 filed on Apr. 12, 2011 which is hereby incorporated by reference in its entirety.

Referring now to just the insert 104, with the understanding that the insert 102 may contain the same features as the insert 104, the insert 104 may include an inner surface 110 and an outer surface 112. In an embodiment of the present disclosure, both the inner surface 110 and the outer surface 112 may be substantially annularly shaped. The inner surface 110 may define a passageway through the insert 104. In an embodiment of the present disclosure, the passageway through the insert 104 may be annularly shaped. In an embodiment of the present disclosure, the passageway through the insert 104 may not be annularly shaped. An annularly-shaped top surface 114 may extend between the inner surface 110 and the outer surface 112. An annularly-shaped bottom surface 116 may extend between the inner surface 110 and the outer surface 112.

A height, indicated by the double arrows marked with the reference numeral 118, between the top surface 114 and the bottom surface 116 of the insert 104, may be between about 0.5 feet and twelve feet, or larger than twelve feet if desired, and may in particular be produced in any selective height, including one foot, two feet, three feet, four feet, five feet, six feet, seven feet, eight feet, nine feet, ten feet, eleven feet or twelve feet.

Figure 3:
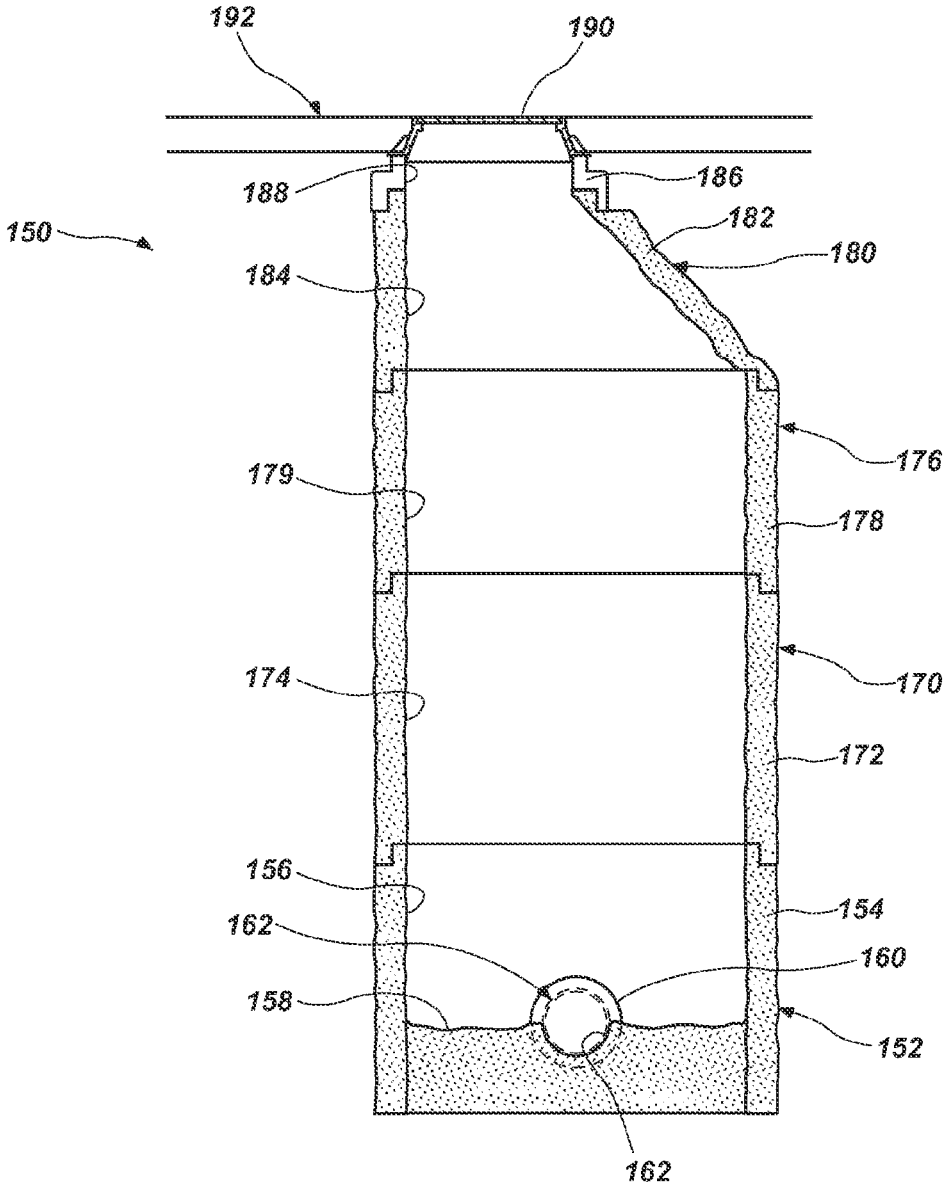
FIG. 3 is a cross-sectional view of a damaged manhole assembly.

An outer diameter of the insert 104, indicated by the double arrows marked with the reference numeral 120, of the outer surface 112 may be between about two to four inches less than an inner diameter of a manhole section under repair, such as manhole 150 of FIG. 3. For example, if a manhole section of manhole 150 has an inner diameter of sixty inches, the outer diameter 120 of insert 104 may for example be between about fifty-six to fifty-eight inches. Accordingly, for the following manhole section inner diameters ("ID's") in the table below, corresponding optional outer diameters ("OD's") 120 of inserts 104 are noted in the table as well:

| Manhole Section ID's | Optional OD's of inserts 104 |
|---|---|
| 48 inches | 44-46 inches, or more or less |
| 60 inches | 56-58 inches, or more or less |
| 72 inches | 68-70 inches, or more or less |
| 84 inches | 80-82 inches, or more or less |
| 96 inches | 92-94 inches, or more or less |

An inner diameter of insert 104, indicated by the double arrows marked with the reference numeral 122, of the inner surface 110, i.e., the passageway through the insert 104, may be between about 3.5 inches and five inches less than an inner diameter of the corresponding manhole section under repair, for any size manhole.

A wall thickness of the insert 104, indicated by the double arrows marked with the reference numeral 124, between the inner surface 110 and the outer surface 112 of the insert 104 may be between about 0.5 inches and 5 inches, and might for example be 1.5 inches or 3 inches, or any size between or including 0.5 inches and 5 inches. In an embodiment of the present disclosure, a wall thickness 124 of the insert 104 may be about 2 inches.

In addition to the features described above, the insert 102 may include at least one semi-circular recess 130 formed in a bottom surface 116*a* for allowing passage of wastewater or piping. In an embodiment of the present disclosure, the insert 102 may include two or more semi-circular recesses 130 formed in the bottom surface 116*a*.

Figure 2:
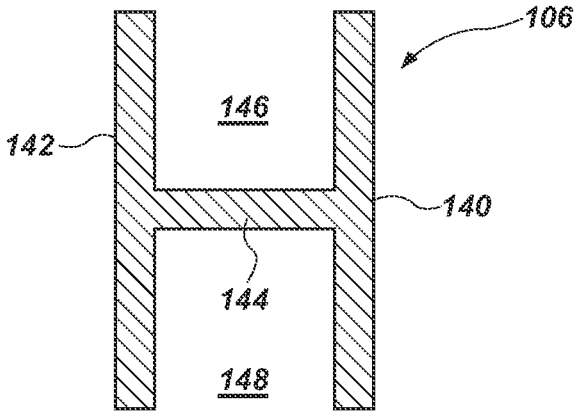
FIG. 2 is a cross-sectional view of a riser alignment guide utilized between adjacent ones of the stacked inserts shown in FIG. 1.

In an embodiment of the present disclosure, the insert 104 may be stackable on top of the insert 102. In an embodiment of the present disclosure, a seal may be formed between the bottom surface 116 of the insert 104 and a top surface 114*a* of the insert 102 by a riser alignment guide 106. As best seen in FIG. 2, in an embodiment of the present disclosure, the riser alignment guide 106 may comprise a substantially H-shaped cross section. In particular, the riser alignment guide 106 may comprise a first sidewall 140 and a second sidewall 142. The first sidewall 140 and the second sidewall 142 may be substantially parallel with respect to each other. A crosspiece member 144 may extend between the mid-sections of the first sidewall 140 and the second sidewall 142. The crosspiece member 144 and the first sidewall 140 and the second sidewall 142 may form a top slot 146 and a bottom slot 148. The top slot 146 may be adapted to receive a lower portion of the insert 104. The bottom slot 148 may be adapted to receive a top portion of the insert 102. The riser alignment guide 106 may, but not necessarily, form a substantially airtight or watertight seal between the inserts 102 and 104. In an embodiment of the present disclosure, the riser alignment guide 106 may be formed of a resilient material, such as rubber or plastic. Flexible butyl mastic per ASTM C990 may be utilized in conjunction with the riser alignment guide 106. The riser alignment guide 106 may also center inserts 102 and 104 with respect to each other.

Referring now back to FIG. 1, it will be appreciated by those having ordinary skill in the art that although only two inserts, namely, inserts 102 and 104, are shown, that a plurality of inserts may be stacked together to obtain a desired height of inserts. For example, stacking three, four, five or even six inserts is within the scope of the present disclosure. A riser alignment guide, such as the riser alignment guide 106, may be utilized to form a seal between each of the adjacent ones of stacked inserts.

Referring now to FIG. 3, there is depicted a manhole assembly 150 pursuant to an embodiment of the present disclosure. Although not explicitly shown, it is to be understood that the manhole assembly 150 may be connected to a functioning wastewater system, such as a municipal sewage or wastewater system. Further, it will be appreciated that the manhole assembly 150 may be substantially below ground level as is known to one having ordinary skill in the art.

The manhole assembly 150 may comprise a base member 152. The base member 152 may comprise a wall 154 having an inner surface 156. The wall 154 may comprise a pair of openings 160 (only one is visible due to the cross-sectional view of FIG. 3). A pipe 162 of a wastewater system may be installed in one of the openings 160. The base member 152 may further comprise a bottom surface 158 that is circumscribed by the wall 154. An invert 162 may be formed in the surface 158. The invert 162 may extend between the openings 160 in the wall 154 such that wastewater may flow through the base member 152 via the invert 162.

A first riser member 170 may be stacked on top of the base member 152. The first riser member 170 and the base member 152 may be connected by a tongue and groove joint as is known to one having ordinary skill in the art. The first riser member 170 may comprise an annular wall 172 having an inner surface 174.

A second riser member 176 may be stacked on top of the first riser member 170. The second riser member 176 and the first riser member 170 may be connected by a tongue and groove joint as is known to one having ordinary skill in the art. The second riser member 176 may comprise an annular wall 178 having an inner surface 179.

Disposed on top of the second riser member 176 may be a cone member 180. The cone member 180 may include a wall 182 having an inner surface 184. A ring member 186 having an inner surface 188 may be disposed on top of the cone member 180. A manhole cover assembly 190 may be disposed on top of the ring member 186. Asphalt or concrete 192 may surround the manhole cover assembly 190 as is known to one having ordinary skill in the art.

The base member 152, the first riser member 170, the second riser member 176, the cone member 180, and the ring member 186 may be formed from pre-cast concrete structures comprising a cement binder and an aggregate. The inner surfaces 156, 174, 179, 184 and 188 of the base member 152, the first riser member 170, the second riser member 176, the cone member 180, and the ring member 186, respectively, may form a inner passageway extending from the manhole cover assembly 190 to the bottom surface 158 of the base member 152. It will be appreciated that the passageway allows access to the wastewater system and in particular to the invert 162 for maintenance purposes.

As depicted by the rough lines in FIG. 3, the inner surfaces 156, 174, 179, 184 and 188 of the base member 152, the first riser member 170, the second riser member 176, the cone member 180, and the ring member 186, respectively may include damaged portions. The damaged portions may be due to the presence of sulfuric acid generated by microbes in the wastewater system. The damaged portions may eventually cause structural failure in the manhole assembly 150. A rehabilitation of the manhole assembly 150 according to the present disclosure may include removing loose material from the damaged portions during the rehabilitation process disclosed herein. For example, an air-powered hammer may be used to remove the loose material from the damaged portions.

FIGS. 4-10 depict a method whereby the manhole assembly 150 may be rehabilitated in place without affecting the operation of a wastewater system pursuant to an embodiment of the present disclosure.

Figure 4:
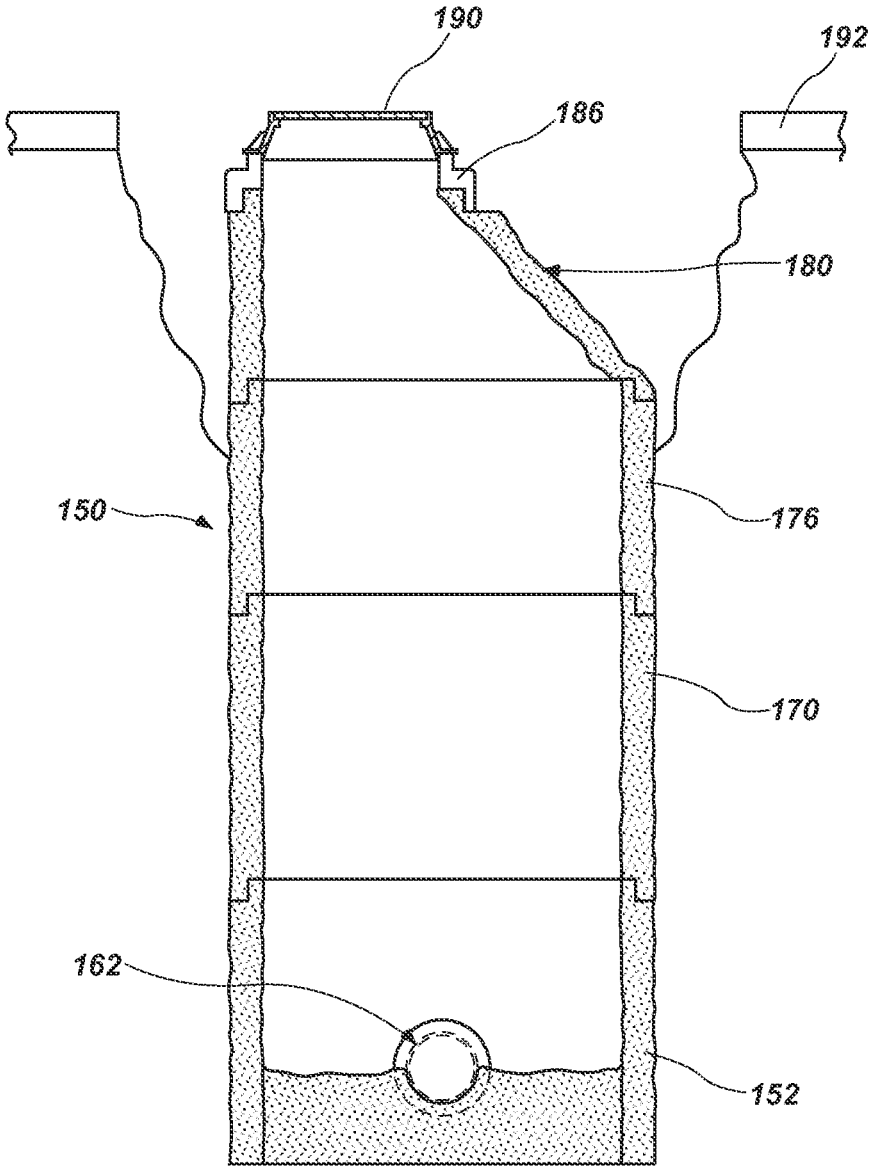
FIG. 4 is a cross-sectional view of the damaged manhole assembly shown in FIG. 3 having dirt around a cone portion excavated.
Figure 5:
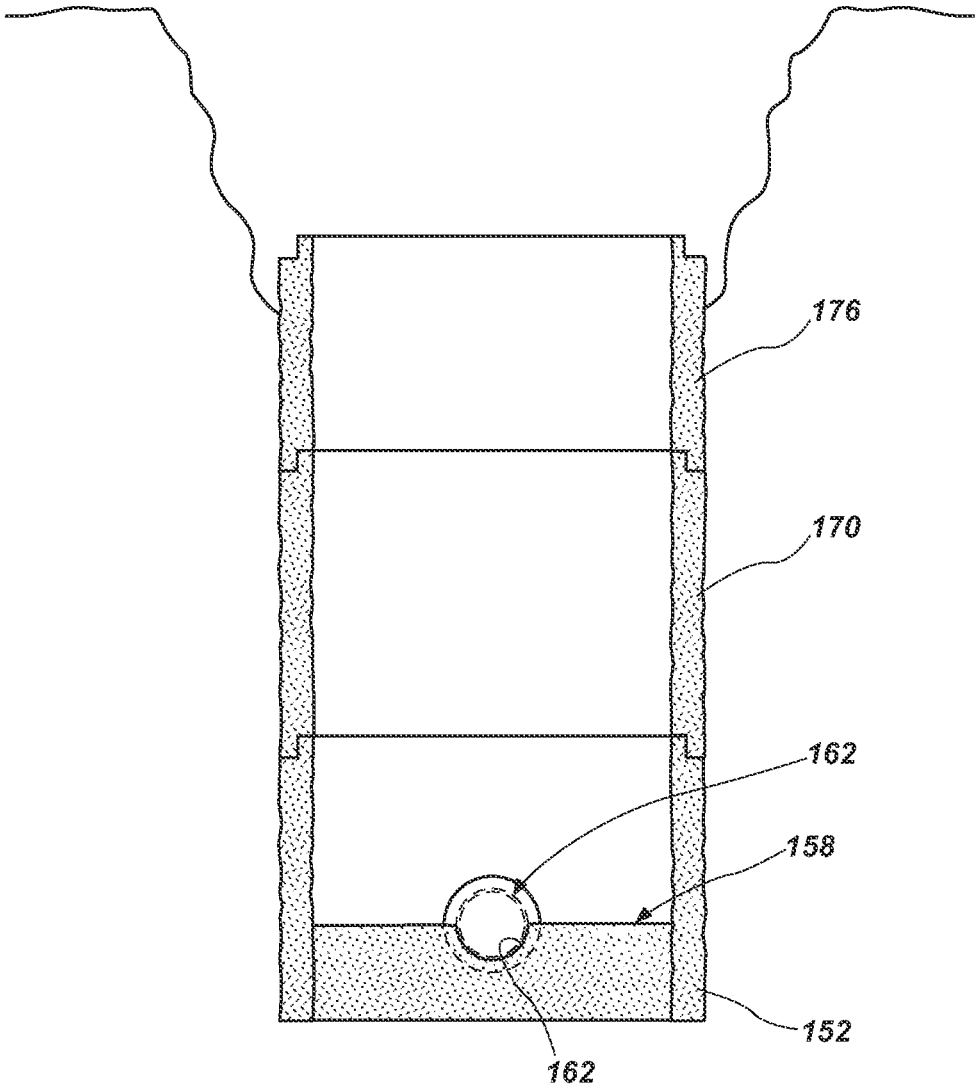
FIG. 5 is a cross-sectional view of the damaged manhole assembly shown in FIG. 3 having the cone portion removed.

Referring now to FIG. 4, the existing concrete or asphalt 192 surrounding the manhole cover assembly 190 may be cut and removed. Dirt may then be removed to expose the cone portion 180 of the manhole assembly 150. Next, as shown in FIG. 5, the ring member 186 and the manhole cover assembly 190 may be removed. The cone portion 180 may also be removed. The surface 158 and invert 162 of the base portion 152 may then be repaired. This may be done by installing a fiberglass layer, shell insert or by applying a grout material.

Figure 6:
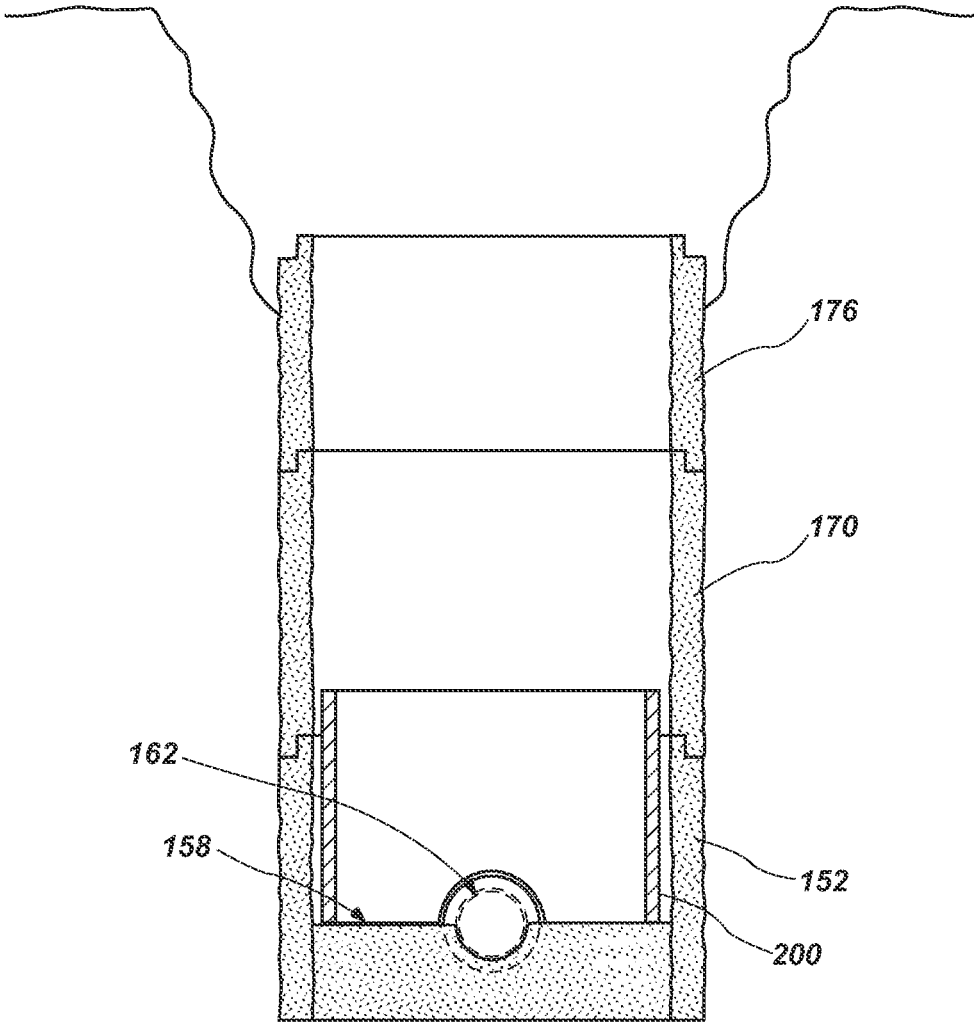
FIG. 6 is a cross-sectional view of the damaged manhole assembly shown in FIG. 3 having a riser insert installed therein.
Figure 7:
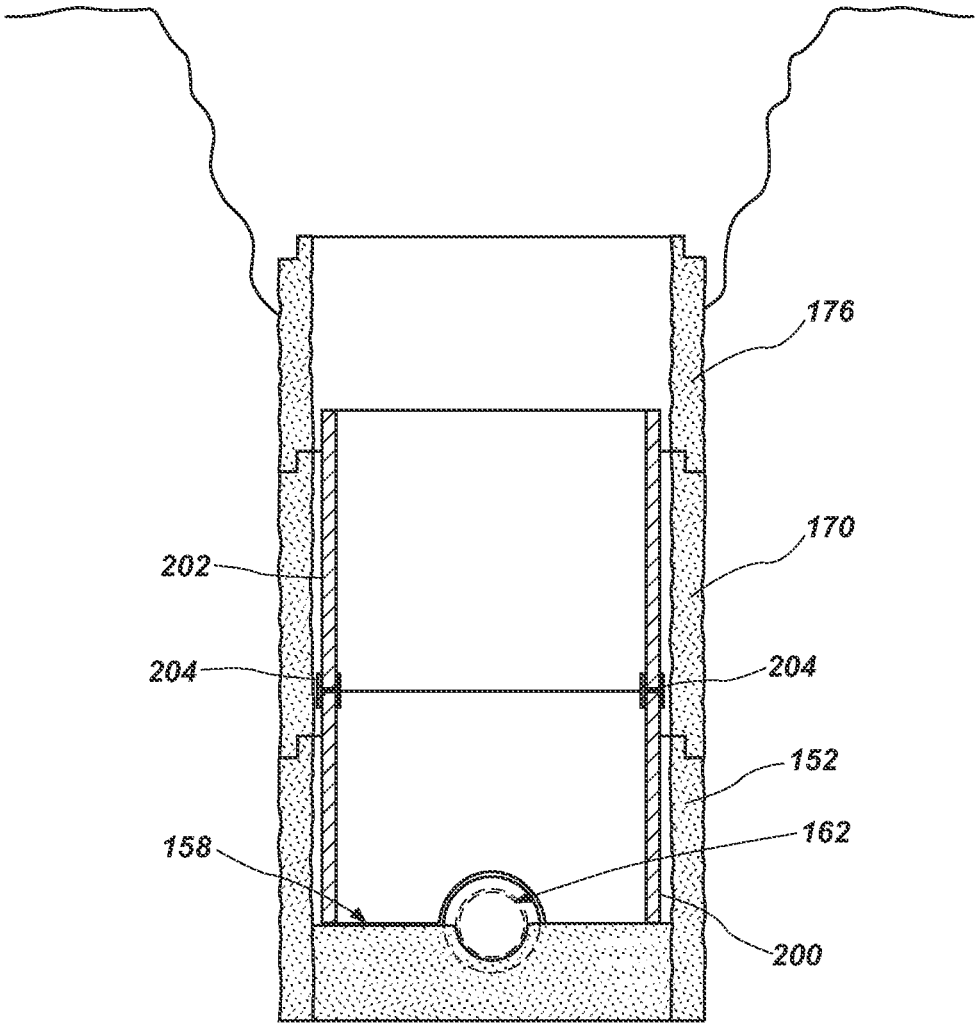
FIG. 7 is a cross-sectional view of the damaged manhole assembly shown in FIG. 3 having a second riser insert installed therein.

Next, as shown in FIG. 6, a new riser insert 200 may be placed onto the surface 158 of the base member 152. The riser insert 200 may take the form of the insert 102 depicted in FIG. 1. Next, as shown in FIG. 7, a riser insert 202 may be installed onto the riser inert 200. The riser insert 202 may take the form of the insert 104 depicted in FIG. 1. A riser alignment guide 204 may be interposed between the riser insert 200 and the riser insert 202. The riser alignment guide 204 may take the form of the riser alignment guide 106 depicted in FIGS. 1 and 2. The riser alignment guide 204 may center the riser insert 200 and the riser insert 202. A suitable mastic may be applied in conjunction with the riser alignment guide 204.

Figure 8:
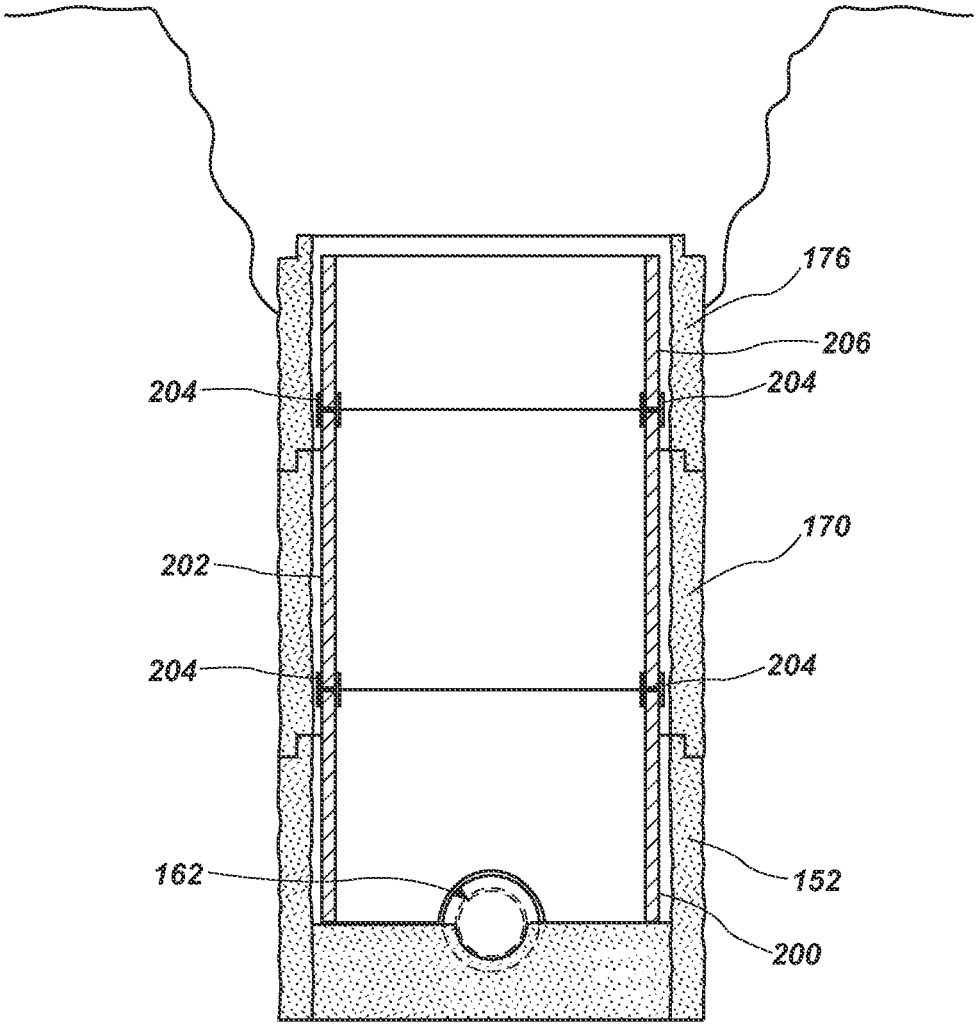
FIG. 8 is a cross-sectional view of the damaged manhole assembly shown in FIG. 3 having a third riser insert installed therein.

Next, as shown in FIG. 8, a riser insert 206 may be installed onto the riser inert 202. The riser insert 206 may take the form of the riser insert 104 depicted in FIG. 1. A riser alignment guide 204 may be interposed between the riser insert 202 and the riser insert 206.

Figure 9:
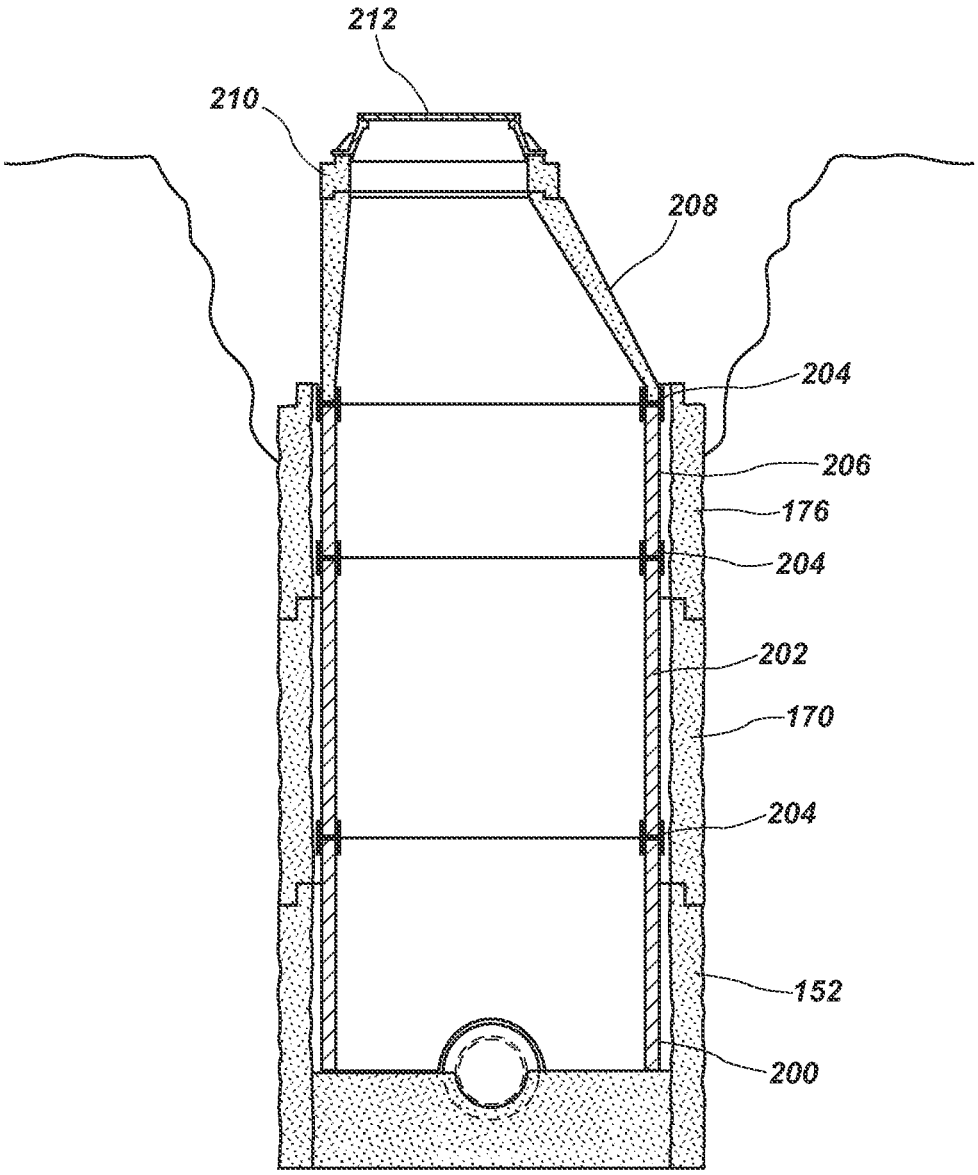
FIG. 9 is a cross-sectional view of the damaged manhole assembly shown in FIG. 3 having a new cone portion installed thereon.
Figure 10:
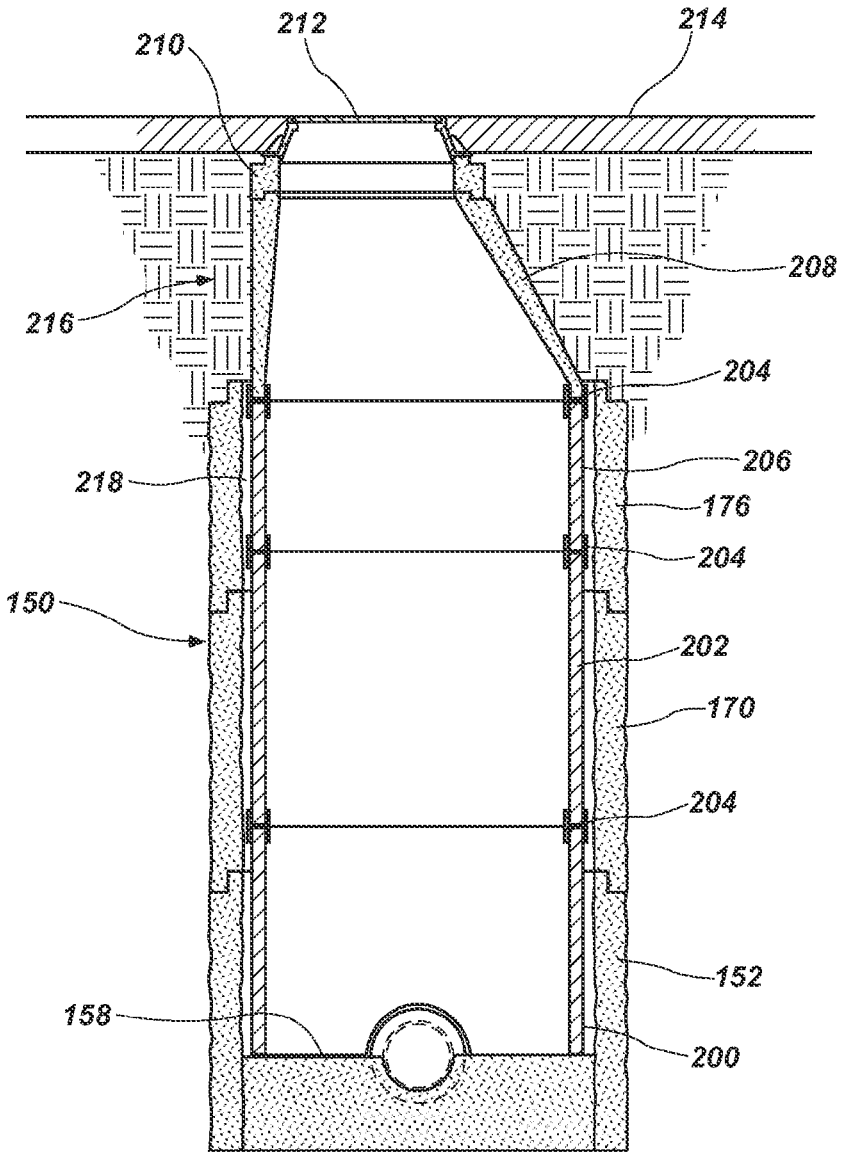
FIG. 10 is a cross-sectional view of the damaged manhole assembly shown in FIG. 3 backfilled after rehabilitation.

Next, as shown in FIG. 9, a new cone portion 208 may be installed onto the riser inert 206. Alternatively, a slab top may be installed onto the riser insert 206. In an embodiment of the present disclosure, the cone portion 208 or alternative slab top may be formed from polymer concrete. A riser alignment guide 204 may be interposed between the cone portion 208 and the riser insert 206. A ring member 210 and cover assembly 212 may also be installed. Next, as shown in FIG. 10, the excavated area around the cone portion 208 may be backfilled with dirt 216 as required. In an embodiment of the present disclosure, a space 218 between the inserts 200, 202 and 208 and the old passage way may also be backfilled with dirt 216. New asphalt or concrete 214 may also be installed.

In an embodiment of the present disclosure, a gap-filling material may be installed or poured in the space 218 formed between the inserts 200, 202, and 206 and the old passageway formed by the base member 152 and the risers 170 and 176. In an embodiment of the present disclosure, the gap-filling material may comprise a grout or thin mortar. The gap-filling material may permanently secure the inserts 200, 202 and 206 107. Some handwork may need to be done with the gap-filling material. The gap-filling material may extend from the bottom surface 158 of the base member 152 to a top of the riser 206. The gap-filling material may be installed before the dirt 216 is backfilled.

As can be observed, inner surfaces of the riser inserts 200, 202 and 206 may form a new passageway through the manhole assembly 150 and the damaged portions of the manhole assembly 150 may have been replaced or rehabilitated. It will be appreciated that the base assembly 152 may not be removed during the rehabilitation process and no interruption of the wastewater system may be necessary. In an embodiment of the present disclosure, the riser inserts 200, 202, 206 and the cone portion 208, and the ring member 210 may be formed of polymer concrete to prevent future corrosion.

Figure 11:
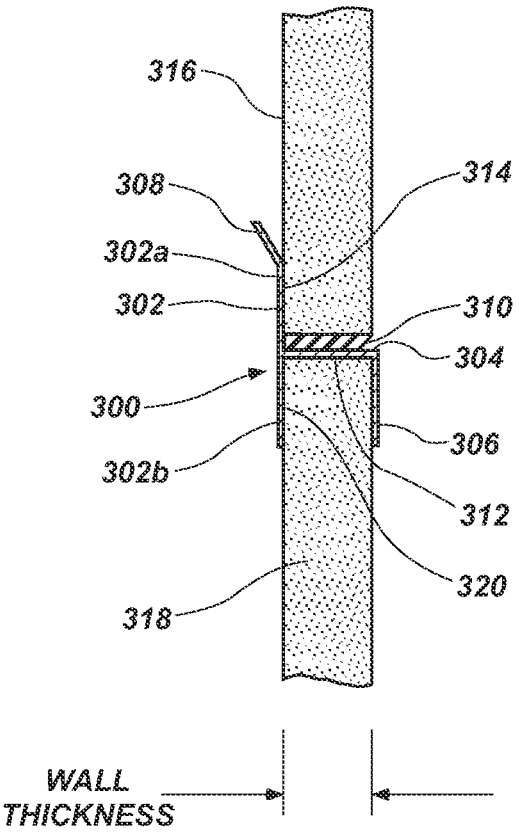
FIG. 11 is a cross-sectional view of an embodiment of a riser alignment guide pursuant to an embodiment of the present disclosure.

Referring now to FIG. 11, there is depicted a riser alignment member 300 according to an embodiment of the present disclosure. It will be appreciated that the riser alignment member 300 may be utilized between any of the riser inserts disclosed herein. The riser alignment member 300 may include a sidewall 302 having a top portion 302*a* and a bottom portion 302*b*. The sidewall 302 may be annular. Extending from the sidewall 302 may be a cross-piece member 304. A leg 306 may extend downwardly from the end of the cross-piece member 304. The top portion 302*a* of the sidewall 302 may include a sloped portion 308.

A top surface 310 of the cross-piece member 304 and an inner surface 314 of the top portion 302*a* of the sidewall 302 may form a seat for receiving a bottom portion of a riser insert 316. A bottom surface 312 of the cross-piece member 304, an inner surface 320 of the bottom portion 302*b* of the sidewall 302 and the leg 306 may form a seat for receiving a top portion of a riser insert 318. A mastic may be used to form a seal.

It will be appreciated that the structure and apparatus disclosed herein is merely one example of a means for rehabilitating a pre-cast concrete structure, and it should be appreciated that any structure, apparatus or system for rehabilitating a pre-cast concrete structure which performs functions the same as, or equivalent to, those disclosed herein are intended to fall within the scope of a means for rehabilitating a pre-cast concrete structure, including those structures, apparatus or systems for rehabilitating a pre-cast concrete structure which are presently known, or which may become available in the future. Anything which functions the same as, or equivalently to, a means for rehabilitating a pre-cast concrete structure falls within the scope of this disclosure.

In accordance with the features and combinations described above, a useful method of rehabilitating a pre-cast concrete structure, such as a manhole assembly, includes the steps of:

(a) providing an insert, the insert comprising an inner wall and an outer wall, said inner wall defining a passageway through said insert, wherein the insert further comprises a binding agent and an aggregate;

(b) placing the insert in the passageway of the pre-cast concrete structure such that the outer wall of the insert and the inner wall of the pre-cast concrete structure define a void therebetween; and (c) inserting grout into the void between the outer wall of the insert and the inner wall of the pre-cast concrete structure.

The method described above may be further specified, such that wherein the step of providing an insert further comprises selecting an insert having an outer diameter that is within a range of two to four inches less than an inner diameter of the pre-cast concrete structure, and wherein the step of placing the insert further comprises placing the insert such that the void is annular in cross-section and has a void thickness that is within a range of one to two inches.

Those having ordinary skill in the relevant art will appreciate the advantages provide by the features of the present disclosure. For example, it is a feature of the present disclosure to provide a system and method for rehabilitating corroded pre-cast concrete structures. Another feature of the present disclosure to provide such a system and method that is capable of re-lining an interior passage with annular inserts that are composed of a polymer concrete. It is a further feature of the present disclosure, in accordance with one aspect thereof, to provide stackable annular inserts for rehabilitating corroded manholes and other pre-cast concrete structures.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A method for rehabilitating a pre-cast concrete structure, the pre-cast concrete structure having an inner wall defining an annular passageway through said pre-cast concrete structure, the method comprising:

providing a plurality of pre-cast, one piece annular inserts, each of the plurality of annular inserts comprising an inner wall and an outer wall, said inner wall defining a passageway through said annular insert, wherein each of the annular inserts comprises a gravel aggregate;

stacking the plurality of annular inserts in the annular passageway such that the outer wall of each of the plurality of annular inserts and the inner wall of the pre-cast concrete structure define a void;

inserting grout into the void between the outer wall of each of the plurality of annular inserts and the inner wall of the pre-cast concrete structure; and further comprising forming a seal between adjacent ones of the stacked plurality of annular inserts;

wherein the seal between adjacent ones of the stacked plurality of annular inserts comprises an H-shaped annular seal.

2. The method of claim 1, wherein each of the plurality of annular inserts comprises a binding agent.

3. The method of claim 2, wherein the binding agent is a polymer.

4. The method of claim 1, wherein each of the plurality of annular inserts further comprises a sand aggregate.

5. The method of claim 1, further comprising removing damaged portions of the pre-cast concrete structure.

6. The method of claim 1, wherein the pre-cast concrete structure is a manhole assembly that is connected to a wastewater system.

7. The method of claim 6, wherein the manhole assembly comprises a riser portion and a base portion.

8. The method of claim 7, wherein the manhole assembly comprises a cone portion.

9. The method of claim 1, wherein the inner wall and the outer wall of an annular insert define a thickness, wherein said thickness is between about 1.5 inches and three inches.

10. The method of claim 1, wherein an annular insert comprises a top surface and a bottom surface, wherein the top surface and the bottom surface define a height, wherein said height is between about one foot and eight feet.

11. A method for rehabilitating, in place, a pre-cast concrete structure forming a working part of a wastewater system, the pre-cast concrete structure comprising a base portion having a top surface, a riser portion having an inner wall forming a passageway, and a top portion, said method comprising:

providing a plurality of annular inserts, each of the plurality of annular inserts comprising an inner wall and an outer wall, said inner wall defining a passageway through said annular insert, wherein each of the annular inserts is a pre-cast, one piece structure comprising gravel;

removing the top portion to thereby expose the passageway through the riser portion;

stacking the plurality of annular inserts in the annular passageway such that the outer wall of each of the plurality of annular inserts and the inner wall of riser portion define a void;

inserting grout into the void between the outer wall of each of the plurality of annular inserts and the inner wall of the pre-cast concrete structure; and further comprising forming a seal between adjacent ones of the stacked plurality of annular inserts;

wherein the seal between adjacent ones of the stacked plurality of annular inserts comprises an H-shaped annular seal.

12. The method of claim 11, wherein each of the plurality of annular inserts comprises a binding agent.

13. The method of claim 12, wherein the binding agent is a polymer.

14. The method of claim 11, wherein each of the plurality of annular inserts further comprises a sand aggregate.

15. The method of claim 11, further comprising removing damaged portions of the pre-cast concrete structure.

16. The method of claim 11, wherein the inner wall and the outer wall of an annular insert define a thickness, wherein said thickness is between about 1.5 inches and three inches.

17. The method of claim 11, wherein an annular insert comprises a top surface and a bottom surface, wherein the top surface and the bottom surface define a height, wherein said height is between about one foot and eight feet.

18. A method for rehabilitating, in place, a pre-cast concrete structure forming a working part of a wastewater system, the pre-cast concrete structure comprising a base portion having a surface, a riser portion having an inner wall forming a passageway, and a top portion, said method comprising:

providing a plurality of annular inserts, each of the plurality of annular inserts comprising an inner wall and an outer wall, said inner wall defining a passageway through said annular insert, each of the plurality of annular inserts comprising a polymer and aggregate material, the aggregate material comprising sand and gravel;

removing the top portion to thereby expose the passageway through the riser portion;

removing damaged portions of the riser portion;

stacking the plurality of annular inserts in the annular passageway such that the outer wall of each of the plurality of annular inserts and the inner wall of riser portion define a void;

forming a seal between adjacent ones of the stacked plurality of annular inserts; and inserting grout into the void between the outer wall of each of the plurality of annular inserts and the inner wall of the riser portion;

wherein the inner wall and the outer wall of an annular insert define a thickness, wherein said thickness is between about 1.5 inches and three inches;

wherein an annular insert comprises a top surface and a bottom surface, wherein the top surface and the bottom surface define a height, wherein said height is between one foot and eight feet;

wherein the seal between adjacent ones of the stacked plurality of annular inserts comprises an H-shaped annular seal.

19. A method for rehabilitating a pre-cast concrete structure, the pre-cast concrete structure having an inner wall defining an annular passageway through said pre-cast concrete structure, the method comprising:

providing a plurality of annular inserts, each of the plurality of annular inserts comprising an inner wall and an outer wall, said inner wall defining a passageway through said annular insert;

stacking the plurality of annular inserts in the annular passageway such that the outer wall of each of the plurality of annular inserts and the inner wall of the pre-cast concrete structure define a void;

inserting grout into the void between the outer wall of each of the plurality of annular inserts and the inner wall of the pre-cast concrete structure; and further comprising forming a seal between adjacent ones of the stacked plurality of annular inserts;

wherein the seal between adjacent ones of the stacked plurality of annular inserts comprises an H-shaped annular seal.

20. The method of claim 19 wherein each of the plurality of annular inserts is a one piece structure.

21. The method of claim 19 wherein each of the plurality of annular inserts is a pre-cast structure.

22. The method of claim 21 wherein each of the plurality of annular inserts further comprises a binding agent and an aggregate.

23. The method of claim 22, wherein the binding agent comprises a polymer.

24. The method of claim 22, wherein the aggregate further comprises at least one of sand and gravel.

25. The method of claim 19, further comprising removing damaged portions of the pre-cast concrete structure prior to placing an insert into the passageway of the pre-cast concrete structure.

26. The method of claim 19, wherein the pre-cast concrete structure is a manhole assembly that is connected to a wastewater system.

27. The method of claim 19, wherein the inner wall and the outer wall of an insert define therebetween a wall thickness, wherein said wall thickness is between about 1.5 inches and three inches.

28. The method of claim 19, wherein an insert comprises a top surface and a bottom surface, wherein the top surface and the bottom surface define therebetween a height, wherein said height is between about one foot and eight feet.

29. The method of claim 19, wherein an insert is cylindrically shaped.

30. The method of claim 19, wherein the step of providing a plurality of annular inserts further comprises selecting an insert having an outer diameter that is within a range of two to four inches less than an inner diameter of the pre-cast concrete structure, and wherein the step of stacking the inserts further comprises placing the insert such that the void is annular in cross-section and has a void thickness that is within a range of two to four inches.

31. A method for rehabilitating, in place, a pre-cast concrete structure forming a working part of a wastewater system, the pre-cast concrete structure comprising a base portion having a top surface, a riser portion having an inner wall forming a passageway, and a top portion, said method comprising:

providing a plurality of annular inserts, each of the plurality of annular inserts comprising an inner wall and an outer wall, said inner wall defining a passageway through said annular insert;

removing the top portion to thereby expose the passageway through the riser portion;

stacking the plurality of annular inserts in the annular passageway such that the outer wall of each of the plurality of annular inserts and the inner wall of riser portion define a void;

inserting grout into the void between the outer wall of each of the plurality of annular inserts and the inner wall of the riser portion; and further comprising forming a seal between adjacent ones of the stacked plurality of annular inserts;

wherein the seal between adjacent ones of the stacked plurality of annular inserts comprises an H-shaped annular seal.

32. The method of claim 31 wherein each of the plurality of annular inserts is a one piece structure.

33. The method of claim 31 wherein each of the plurality of annular inserts is a pre-cast structure.

34. The method of claim 33 wherein each of the plurality of annular inserts further comprises a binding agent and an aggregate.

35. The method of claim 34, wherein the binding agent comprises a polymer.

36. The method of claim 34, wherein the aggregate further comprises at least one of sand and gravel.

37. The method of claim 31, further comprising removing damaged portions of the pre-cast concrete structure prior to placing an insert into the passageway of the pre-cast concrete structure.

38. The method of claim 31, wherein the pre-cast concrete structure is a manhole assembly that is connected to a wastewater system.

39. The method of claim 31, wherein the inner wall and the outer wall of an insert define therebetween a wall thickness, wherein said wall thickness is between about 1.5 inches and three inches.

40. The method of claim 31, wherein an insert comprises a top surface and a bottom surface, wherein the top surface and the bottom surface define therebetween a height, wherein said height is between about one foot and eight feet.

41. The method of claim 31, wherein the step of providing a plurality of annular inserts further comprises selecting an insert having an outer diameter that is within a range of two to four inches less than an inner diameter of the pre-cast concrete structure, and wherein the step of stacking the inserts further comprises placing the insert such that the void is annular in cross-section and has a void thickness that is within a range of two to four inches.

* * * * *